US008109610B2

(12) United States Patent
Toge et al.

(10) Patent No.: US 8,109,610 B2
(45) Date of Patent: Feb. 7, 2012

(54) LIQUID EJECTING HEAD AND LIQUID EJECTING APPARATUS USABLE THEREWITH

(75) Inventors: Yoshiyuki Toge, Yokohama (JP); Yoshiyuki Imanaka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/539,215

(22) Filed: Aug. 11, 2009

(65) Prior Publication Data

US 2009/0295874 A1 Dec. 3, 2009

Related U.S. Application Data

(62) Division of application No. 11/140,999, filed on Jun. 1, 2005, now Pat. No. 7,591,538.

(30) Foreign Application Priority Data

Jun. 2, 2004 (JP) ..... 2004-164555

(51) Int. Cl.
*B41J 2/14* (2006.01)

(52) U.S. Cl. ..... 347/50; 347/58; 347/59

(58) Field of Classification Search ..... 347/50, 347/58, 59, 87
See application file for complete search history.

(56) References Cited

U.S. PATENT DOCUMENTS 5,315,472 A * 5/1994 Fong et al. ..... 361/212
5,411,343 A * 5/1995 Childers ..... 400/692
5,610,635 A * 3/1997 Murray et al. ..... 347/7
5,646,660 A 7/1997 Murray ..... 347/59
5,748,209 A * 5/1998 Chapman et al. ..... 347/50
6,000,787 A 12/1999 Weber et al.
6,003,977 A 12/1999 Weber et al.
6,053,598 A * 4/2000 Inpyn ..... 347/49
6,074,041 A 6/2000 Imanaka
6,099,108 A 8/2000 Weber et al.
6,113,221 A 9/2000 Weber
6,126,276 A 10/2000 Davis et al.
6,155,670 A 12/2000 Weber et al.

(Continued)

FOREIGN PATENT DOCUMENTS

EP 0 640 490 3/1995

(Continued)

OTHER PUBLICATIONS

Communication dated Oct. 2, 2008 from the Canadian Patent Office in Canadian Patent application No. 2,508,867.

(Continued)

*Primary Examiner* — Matthew Luu
*Assistant Examiner* — Henok Legesse
(74) *Attorney, Agent, or Firm* — Fitzpatrick, Cella, Harper & Scinto

(57) ABSTRACT

A liquid ejecting head for ejection liquid includes an electric wiring member including a plurality of contact pads which are electrically contactable to a liquid ejecting apparatus; a storing element for storing individual information; and a liquid ejection member, provided with an ejection outlet, for ejecting the liquid using electric energy supplied through a part of the plurality of contact pads. The contact pads include an array of information contact pads electrically connected with the storing element, a voltage source contact pad for supplying the electric energy and a grounding contact pad. Directly adjacent to each of front and rear sides of the information contact pads constituting the array, the voltage source contact pad or the grounding contact pad is disposed.

11 Claims, 13 Drawing Sheets

U.S. PATENT DOCUMENTS

| | | | | |
|---|---|---|---|---|
| 6,162,589 | A | 12/2000 | Chen et al. | |
| 6,273,557 | B1 | 8/2001 | Milligan et al. | |
| 6,303,274 | B1 | 10/2001 | Chen et al. | |
| 6,305,790 | B1 | 10/2001 | Kawamura et al. | |
| 6,310,639 | B1 | 10/2001 | Kawamura et al. | |
| 6,336,714 | B1 | 1/2002 | Kawamura et al. | |
| 6,354,694 | B1 | 3/2002 | Weber et al. | |
| 6,402,972 | B1 | 6/2002 | Weber et al. | |
| 6,439,680 | B1 | 8/2002 | Mochizuki et al. | |
| 6,447,102 | B1 | 9/2002 | Chen et al. | |
| 6,454,379 | B1 | 9/2002 | Taneya et al. | |
| 6,467,863 | B1 | 10/2002 | Imanaka et al. | |
| 6,474,769 | B1 | 11/2002 | Imanaka et al. | |
| 6,502,917 | B1 * | 1/2003 | Shinada et al. | 347/19 |
| 6,536,871 | B1 * | 3/2003 | Haddick et al. | 347/50 |
| 6,540,316 | B1 | 4/2003 | Imanaka et al. | |
| 6,543,884 | B1 | 4/2003 | Kawamura et al. | |
| 6,648,445 | B2 * | 11/2003 | Ishizawa et al. | 347/19 |
| 6,652,072 | B2 | 11/2003 | Browning et al. | |
| 6,688,729 | B1 | 2/2004 | Imanaka et al. | |
| 6,786,572 | B2 | 9/2004 | Imanaka et al. | |
| 6,837,573 | B2 | 1/2005 | Browning et al. | |
| 7,032,994 | B2 * | 4/2006 | O'Hara et al. | 347/50 |
| 2001/0002135 | A1 | 5/2001 | Milligan et al. | |
| 2001/0012032 | A1 | 8/2001 | Kawamura et al. | |
| 2001/0053501 | A1 | 12/2001 | Chen et al. | |
| 2002/0071006 | A1 | 6/2002 | Chen et al. | |
| 2002/0101479 | A1 | 8/2002 | Giere et al. | |
| 2002/0140751 | A1 * | 10/2002 | Imanaka et al. | 347/9 |
| 2002/0145644 | A1 | 10/2002 | Chen et al. | |
| 2003/0063158 | A1 | 4/2003 | Browning et al. | |
| 2003/0063162 | A1 | 4/2003 | Yoshihira et al. | |
| 2003/0137562 | A1 | 7/2003 | Kawamura et al. | |
| 2003/0151647 | A1 | 8/2003 | Giere et al. | |
| 2004/0021709 | A1 | 2/2004 | Hayasaki | |
| 2004/0021710 | A1 | 2/2004 | Hayasaki | |
| 2004/0104967 | A1 | 6/2004 | Kim et al. | |

FOREIGN PATENT DOCUMENTS

| | | |
|---|---|---|
| EP | 0 916 503 | 5/1999 |
| EP | 1 219 437 | 7/2002 |
| JP | 61-189978 | 8/1986 |
| JP | 3-126560 | 5/1991 |
| JP | 4-182175 | 6/1992 |
| JP | 6-91877 | 4/1994 |
| JP | 7-60953 | 3/1995 |
| JP | 2004-34715 | 2/2004 |
| JP | 2004-106539 | 4/2004 |
| KR | 2004-0012554 | 2/2004 |
| RU | 2 221 701 | 1/2004 |
| WO | WO 02/074545 | 9/2002 |
| WO | 03/029010 | 4/2003 |
| WO | WO 03/076912 | 9/2003 |

OTHER PUBLICATIONS

Office Action issued in corresponding European patent application No. 05011941.1.-2304 on Jun. 27, 2007.

Decision on Grant issued in corresponding Russian application No. 2005116828/12(019191) on Jul. 5, 2007.

* cited by examiner

LIQUID EJECTING HEAD AND LIQUID EJECTING APPARATUS USABLE THEREWITH

This is a division of U.S. patent application Ser. No. 11/140,999, filed Jun. 1, 2005.

FIELD OF THE INVENTION AND RELATED ART

The present invention relates to a liquid ejecting head for ejecting liquid such as ink and a liquid ejecting apparatus using the same. The liquid ejecting apparatus is applicable to an ordinary printer which effects recording by ejecting ink, a copying machine, a facsimile machine having a communication system, a multi-function recording device having such functions in combination, or the like, and in addition to an apparatus for forming a figure or a pattern by ejecting liquid other than ink.

It has been proposed that an ink jet recording head, which is a typical one of liquid ejecting heads, is provided on an ink jet recording substrate with a ROM (Read Only Memory) to store data such as individual information for the particular head such a its ID (Identity), a particular driving property of its ink ejecting mechanism. For example, Japanese Laid-open Patent Application Hei 3-126560 discloses an ink jet recording head having an EEPROM (Electrically Erasable Programmable ROM).

It is known that heat generating resistors for generating energy for ink ejection are constituted in a plurality of lamination film layers on a base portion of an ink jet recording substrate of the ink jet recording head, and a resistance indicative of information particular to the head (or individual information) is formed. This is useful when the amount of the information to be stored is relatively small. The particular information of the head is acquired by the ink jet recording apparatus, on which the ink jet recording head is mounted, reading the value of the resistance of the resistor formed on the base substrate, on the basis of which the ink jet recording apparatus side can effect optimum drive controls for the liquid ejection from the ink jet recording head.

Japanese Laid-open Patent Application Hei 6-91877 discloses that when the lamination film layers constituting the ink ejection portion are formed on the base substrate for manufacturing the ink jet recording head, a fuse (ROM) is simultaneously formed. By selectively melting the fuse by controlling a logic circuit formed simultaneously, binary data can be written and stored on the basis of the state of the fuse.

With the ink jet head using such an ink jet recording substrate, the particular information of the head is stored, and still, the structure is simplified, and the production property and cost saving is good.

In the case of such an ink jet recording head as is capable of recording the information, a measure should be taken against static electricity. Particularly, in the case of an ink jet recording head detachably mountable to a main assembly of the ink jet recording apparatus, the ink jet recording head is necessarily touched by the user's hand or fingers upon the mounting thereof to the main assembly of the apparatus. For example, when the head and the ink container are integral, an ink jet recording head is mounted each time the ink in the ink container is used up, and the head is touched by the user's hand or fingers each time of the mounting. When an ink jet recording apparatus is selectively usable as a normal image quality recording machine or as a photographic (high image quality) recording machine by replacing the recording head with that of another kind, the ink jet recording head is touched by the user each time of replacement. In such operations, it is desirable to protect the ink jet recording head from static electricity. For such a purpose, Japanese Laid-open Patent Application Hei 07-060953 discloses provision of an electrical discharge circuit around contact pads for electrical connection with the main assembly of the ink jet recording apparatus.

However, the conventional ink jet recording head capable of storing the information involves the following problems.

The ink jet recording head having the storing element such as a ROM or EEPROM disclosed in Japanese Laid-open Patent Application Hei 3-26560 or Japanese Laid-open Patent Application Hei 6-91877 unavoidably has a complicated structure, and therefore, various improvements for a high production property or for reduction in size and weight are desired. Fundamentally, a ROM chip is advantageous when the amount of recording data is large, but it is disadvantageous when the amount is small.

In addition, the problem of the static electricity is not taken into account. When the size of the storing element for storing the particular information on the head substrate, the contact for outputting the particular information of the head is relative weaker against the static electricity, and therefore, there is a liability that the storing element is broken, or the content of the stored information is changed when the head is touched by the user. In view of this, measurement against the static electricity is important.

In the ink jet recording head disclosed in Japanese Laid-open Patent Application Hei 07-06095 33, the influence of the static electricity can be avoided, but it is required to provide a discharge circuit on the substrate separately. For this reason, improvements in the space efficiency, downsizing and/or cost reduction are desired.

SUMMARY OF THE INVENTION

Accordingly, the present invention can provide a liquid ejecting head and a liquid ejecting apparatus usable therewith, wherein the influence of the static electricity is suppressed with a simple structure.

The present invention can also provide a liquid ejecting head and a liquid ejecting apparatus wherein the discharge during handling of the liquid ejecting head more easily occurs to a voltage source contact pad or a grounding contact pad than to an information output contact pad, by which the problem of the breakdown of unintentional overwriting or rewriting of the information in the storing element due to the electric discharge is minimized.

According to an aspect of the present invention, there is provided a liquid ejecting head for ejecting liquid, comprising an electric wiring member including a plurality of contact pads which are electrically contactable to a liquid ejecting apparatus; a storing element for storing individual information; a liquid ejection member, provided with an ejection outlet for ejecting the liquid, for ejecting the liquid using electric energy supplied through a part of said plurality of contact pads, wherein said contact pads include an information contact pad electrically connected with said storing element, a voltage source contact pad for supplying the electric energy and a grounding contact pad, and said voltage source contact pad or said grounding contact pad is disposed at each of both sides of said information output contact pad, with no individual information contact pad which is electrically contactable to the liquid ejecting apparatus therebetween.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be made as to the embodiments of the present invention in conjunction with the accompanying drawings.

FIG. 5 to FIG. 12 illustrate an ink jet recording head or an ink jet recording apparatus which is a liquid ejecting head or a liquid ejecting apparatus according to the present invention. The respective constituent-elements will be described.

Figure 5:
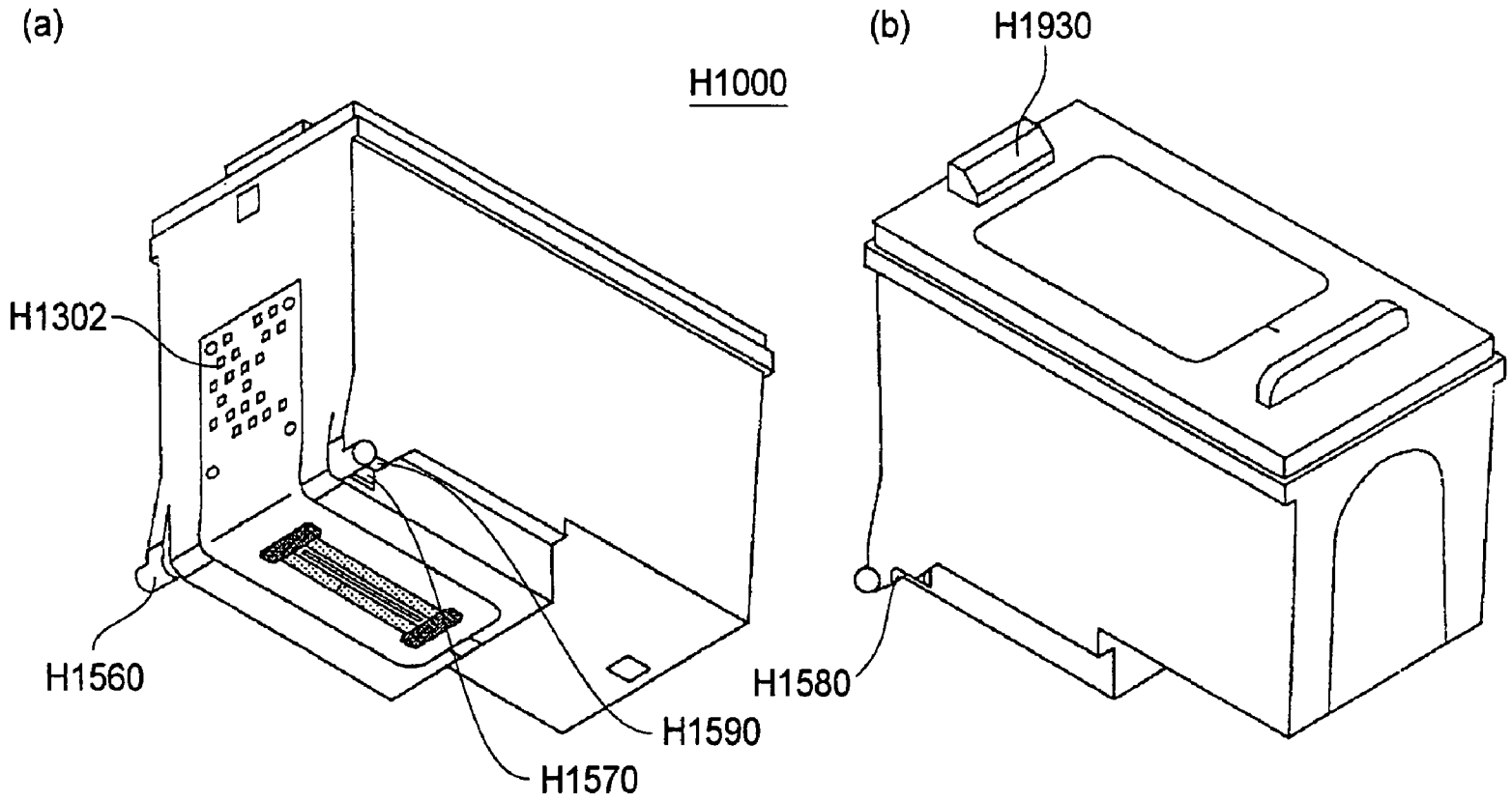
FIG. 5 is a perspective view illustrating a first ink jet recording head using the wiring substrate shown in FIG. 2.
Figure 8:
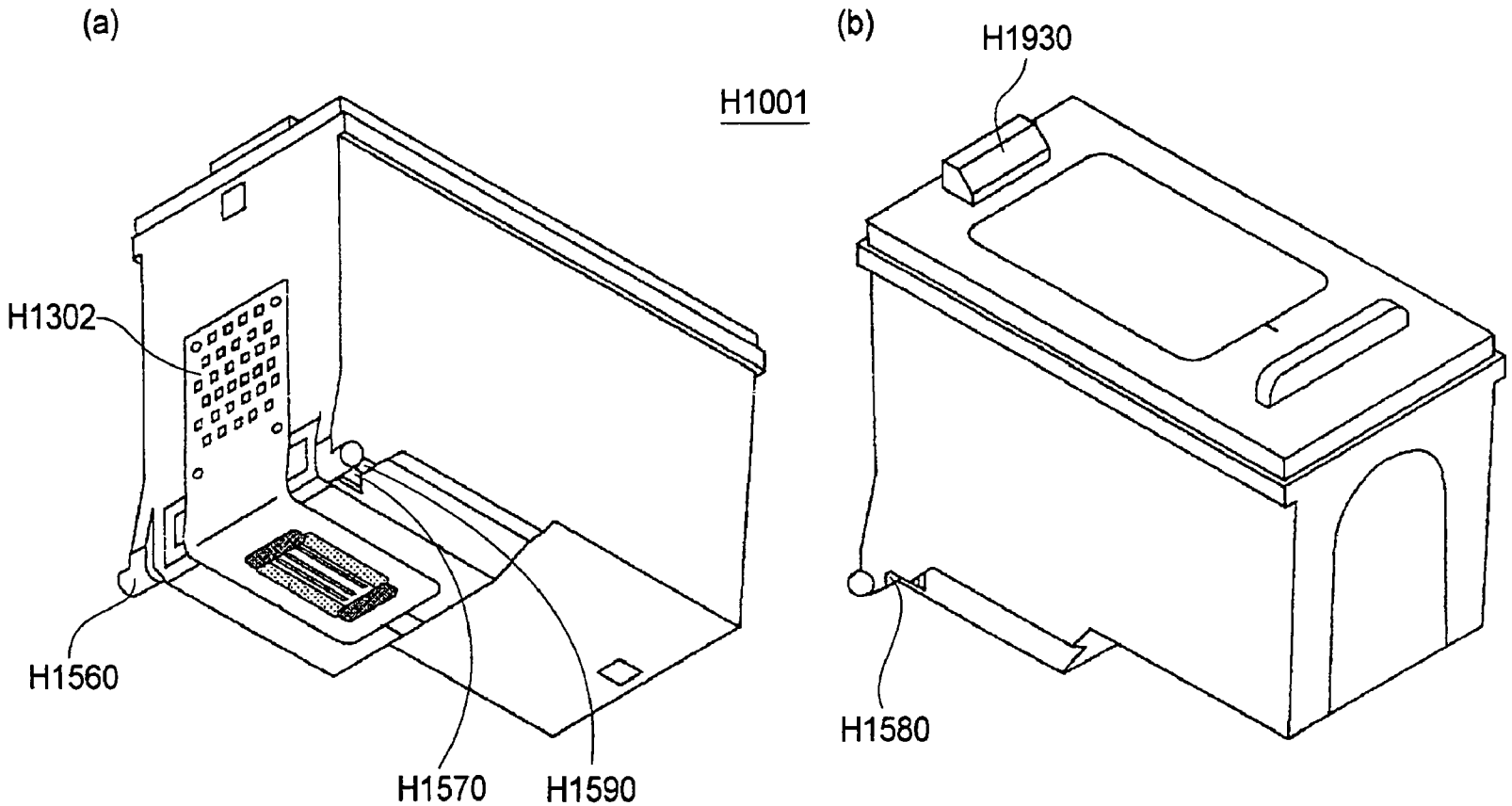
FIG. 8 is a perspective view illustrating the second ink jet recording head using a wiring substrate for the ink jet recording head of FIG. 1.

The recording head of this embodiment is of a type integral with an ink container, and may be a first recording head H1000 filled with black ink, as shown in (a) and (b) of FIG. 5, and may be a second recording head H1001 filled with color inks (cyan ink, magenta ink and yellow ink), as shown in (a) and (b) of FIG. 8. The recording head H1000 or H1001 is securely supported on a carriage 102 of a main assembly of the ink jet recording apparatus by positioning means and electrical contacts, and is detachably mountable to the carriage 102. When the ink is used up, the recording head can be replaced.

The description will be made as to the structures of the recording heads H1000 and H1001 in detail.

(Recording Head)

The first recording head H1000 and the second recording head H1001 are both of a type using an electrothermal transducer for generating thermal energy for creating film boiling in the ink in response to an electric signal, and the electrothermal transducer functions as a recording element and is disposed opposed to an ink ejection outlet. In this embodiment, the recording head integrally comprises a recording element substrate for ejecting the ink (in this embodiment, the liquid ejection member is provided with ejection outlets for ejecting the liquid, and the liquid is ejected using the supplied electric power), and an ink container for retaining and storing the ink to be supplied to the recording element substrate. However, the present invention is applicable also to a recording head not having the ink container integrally.

Figure 6:
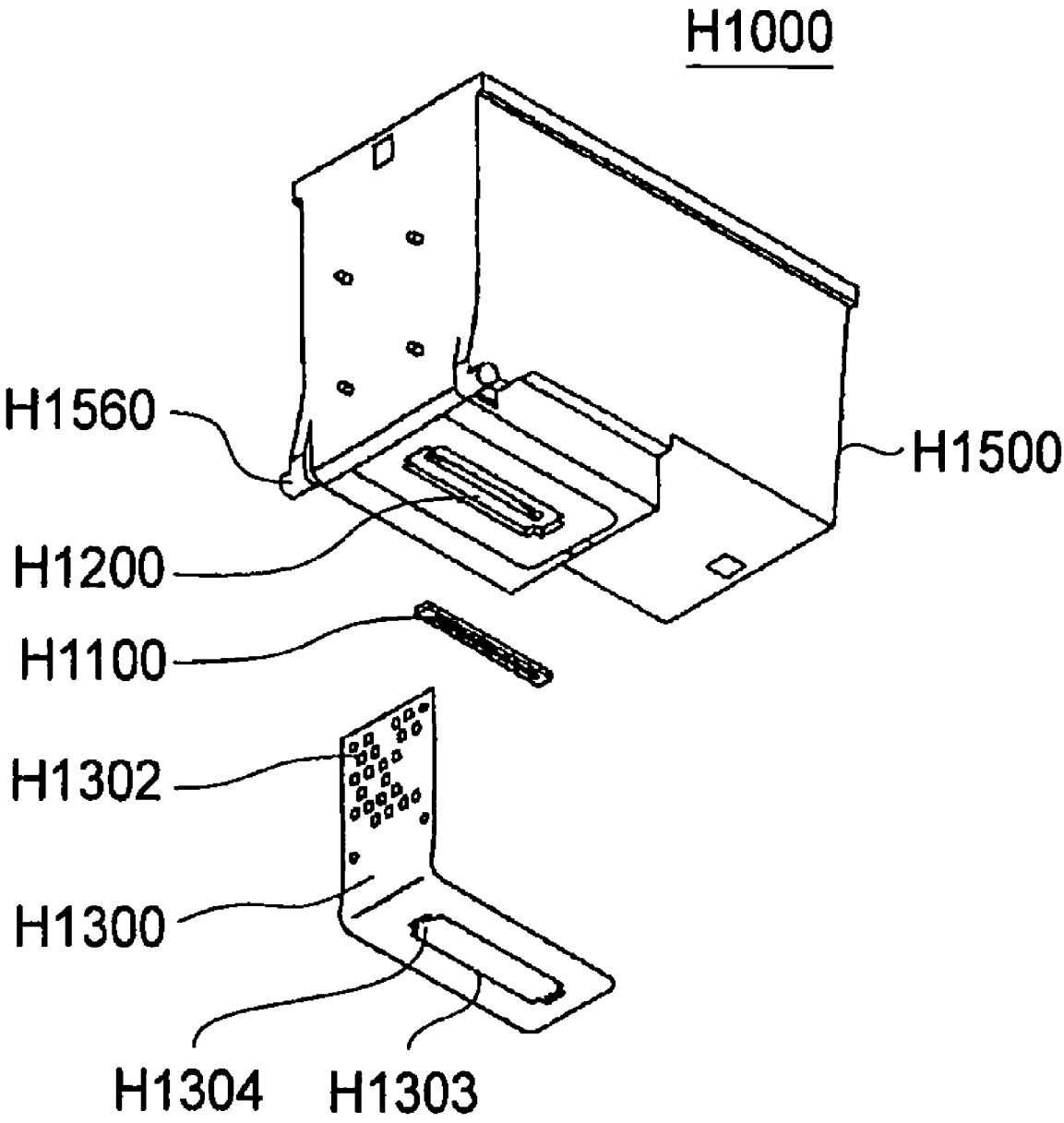
FIG. 6 is an exploded perspective view of an ink jet recording head shown in FIG. 5.

(1) First Recording Head H1000:

FIG. 6 is an exploded perspective view of the first recording head H1000. The first recording head H1000 comprises a first recording element substrate H1100, an electric wiring member (electric wiring sheet) H1300, and an ink retention member H1500.

Figure 7:
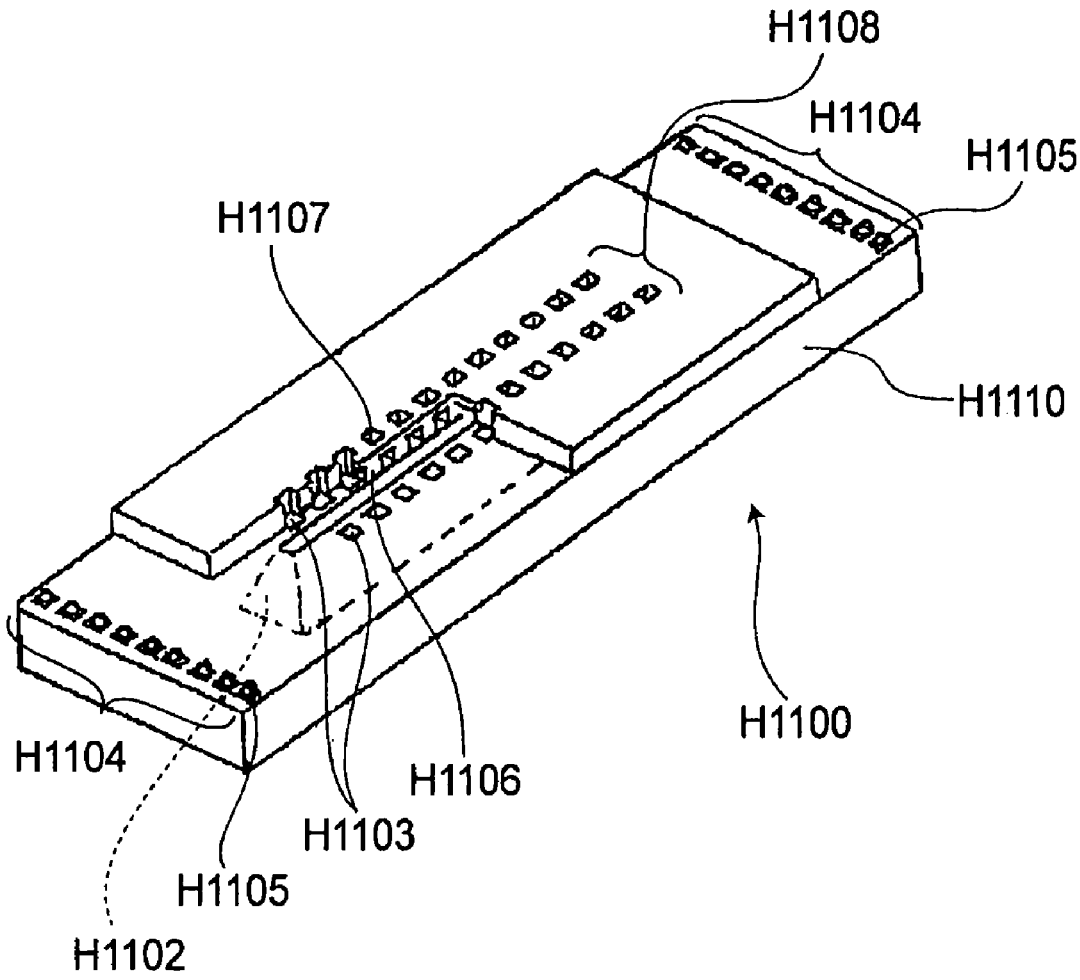
FIG. 7 is a partly broken perspective view of a first recording element substrate constituting the ink jet recording head shown in FIG. 5.

FIG. 7 is a partly broken perspective view of the first recording element substrate H1100.

The first recording element substrate H1100 is constituted by a Si substrate H1110 having a thickness of 0.5 mm-1 mm, in which ink supply port H1102 in the form of an elongated through-opening (ink flow path) is formed. The ink supply port 1102 of the first recording element substrate H1100 is in fluid communication with the ink supply port H1200 of the ink retention member H1500 by bonding and fixing the first recording element substrate H1100 to the ink retention member H1500 with high precision.

The Si substrate H1110 is provided with an array of electrothermal transducer elements H1103 at each lateral side of the ink supply port H1102, so that arrays interpose the ink supply port H1102, and there are further provided unshown electric wiring of Al and the like for supplying electric power to the electrothermal transducer elements H1103.

The Si substrate H1110 is provided along edge portions adjacent opposite ends of the arrays of the electrothermal transducer elements H1103 with electrode portions H1104 for supplying the electric power to the electric wiring and for supplying the electric signals for driving the electrothermal transducer elements H1103, and bumps H1105 of Au are formed at the tops of the electrode portions H1104.

Figure 11:
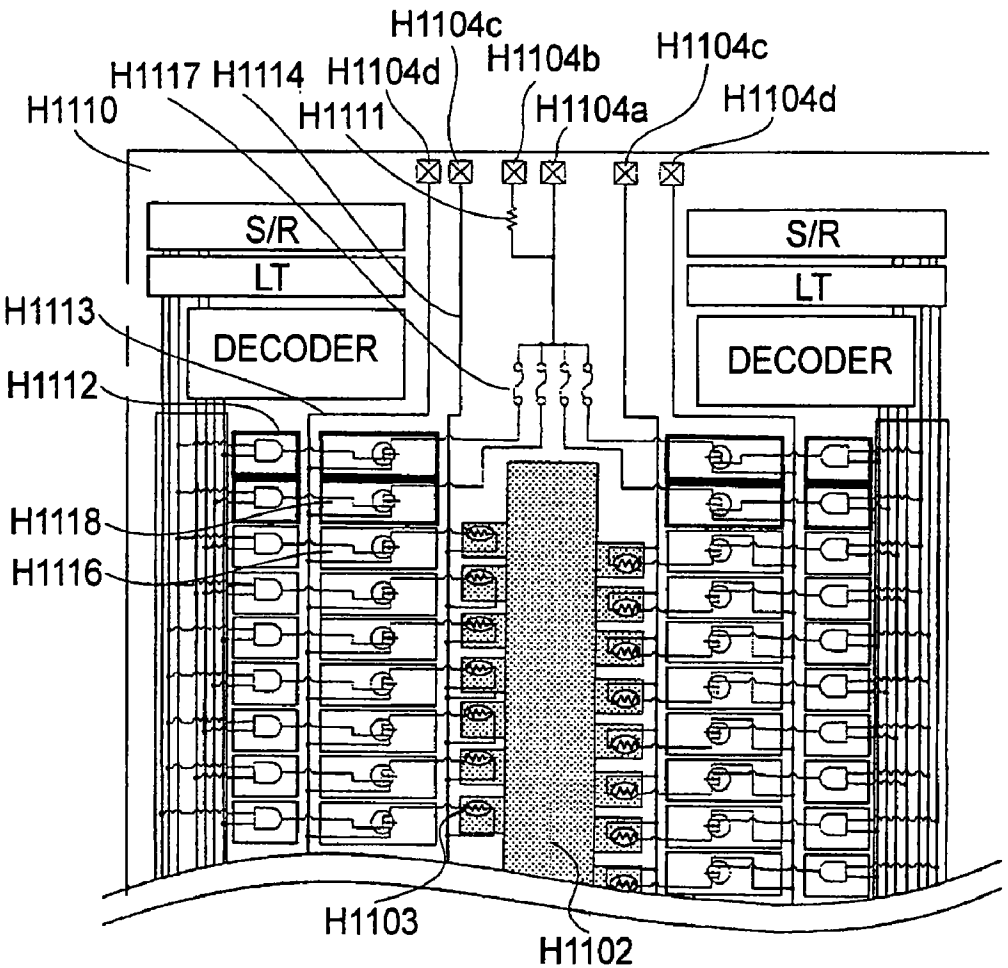
FIG. 11 is a schematic view of a Si substrate including a fuse for storing peculiar information of the head and peripheral circuits therefor, according to the present invention.

The Si substrate H1110 is further provided with a fuse and a peripheral circuit therefor formed thereon, the fuse being effective to store the peculiar information of the head. FIG. 11 show the fuse and the peripheral circuit.

In FIG. 11 the fuse is indicated by a reference H1117. In this example, four fuses H1117 of polysilicon resistor are disposed adjacent a short side of the ink supply port H1102. Each of the fuses H1117 is connected with a second driving element H1118 for melting the fuse and reading the information corresponding to the melting or non-melting of the fuse. The second driving element H1118 is disposed adjacent to the first driving element H1116 for driving the electrothermal transducer element H1103.

A signal for selecting the first driving element H1116 for driving the electrothermal transducer element H1103 is used as the signal for selecting the second driving element H1118 for driving the fuse H1117 as it is. Therefore, the circuit portion for selecting the second driving element H1118 can be formed with the structure similar to the circuit portion for selecting the first driving element H1116. More particularly, the portion from the signal line to which the signal is inputted outside the ink jet recording substrate to the signal line connected to the second driving element H1118 through a shift register, a latching circuit and a decoder, may be common circuit structure with the circuit for selecting the first driving element H1116. The selection circuit H1112 for finally selecting the second driving element H1118 on the basis of the output from the shift register or the like, has a structure similar to the selection circuit for the first driving element H1116.

A VH pad H1104*c* for supplying a voltage from a VH voltage source is connected with the electrothermal transducer element H1103 through the VH wiring lead H1114. A GNDH pad H1104*d* for connection with the GNDH voltage source is commonly connected to the second driving element H1118 connected with the fuse H1117 and the first driving element H1116 connection to the electrothermal transducer element H1103 through the GNDH wiring lead H1113. Namely, the GNDH wiring lead H1113 is common for the first driving element H1116 and the second driving element H1118.

When the fuse H1117 is to be melted, the ID pad H1104*a* functions as a fuse cutting voltage source contact for applying a melting voltage, and when the information indicated by the fuse is to be read out, it functions as a signal output contact. More particularly, when the fuse H1117 is to be melted, a voltage (a driving voltage 24V for the electrothermal transducer element, for example) is applied to the ID pad H1104*a* to instantaneously disconnect the corresponding fuse H1117 by actuating the second driving element H1118 selected by the selection circuit. At this time, the electrical conduction between the ID voltage source pad H1104*b* for reading the information of the fuse out and the outer circuit such as the voltage source for reading the fuse information, is disconnected.

On the other hand, when the information is to be read out, the ID voltage source pad H1104*b* is supplied with a voltage (power source voltage 3.3V of a logic circuit, for example), so that when the fuse H1117 is disconnected, the potential of the ID voltage source pad H1104*b* and that of the ID pad H1104*a* are equal to each other, and therefore, a Hi level voltage is outputted from the ID pad H1104*a*. When the fuse H1117 is not melted, a Lo level voltage is outputted from the ID pad H1104*a* since the fuse H1111 has a resistance value which is far larger than the resistance value of the fuse H1117.

In another example, the fuse H1117 is replaced with a simple wiring on the Si substrate H1110, and the presence or absence of such wiring may indicate information to be stored and read out. In such a case, the peculiar information of the head is written during film formation for the wiring lead on the Si substrate H1110. The reading of the information is exactly the same as the foregoing example, but it is not possible to write information after the formation.

In a further example, a resistance element representing information peculiar to the head is formed on the Si substrate H1110, and one end of the resistance element is connected to the ID pad H1104*a*, and the other end is connected to the GNDH pad H1104*d*. In such a case, the main assembly of the ink jet recording apparatus reads a resistance value between the ID pad H1104*a* and the GNDH pad H1104*d* to acquire the peculiar information of the head corresponding to the resistance value.

In any of such examples, structure of resin material having an ink flow path is formed, for each of the electrothermal transducer elements H1103, on such a side of the Si substrate H1110 as is provided with the fuses, the wiring pattern or the resistance element through a photolithography. The structure has an ink flow passage wall H1106 for defining each of the ink flow paths and a ceiling portion covering the top part thereof, and in the ceiling portion, ejection outlets H1107 are formed. The ejection outlets 1107 are provided opposed to the respective ones of the electrothermal transducer elements H1103, thus constituting a group of ejection outlets H1108.

In the first recording element H1100 thus constituted, the ink supplied from the ink flow path H1102 is ejected through the ejection outlet 1107 opposed to the corresponding electrothermal transducer element H1103 by the pressure of the creation of the bubble caused by heat generation of the electrothermal transducer element H1103.

The electric wiring sheet H1300 is to constitute the electric signal path for applying the electric signal for ejecting the ink to the first recording element substrate H1100, and is formed of a polyimide base material and a wiring lead pattern of copper foil thereon. Also, an opening H1303 for setting the first recording element substrate H1100 is formed, and adjacent the edge of the opening, an electrical contact for connection with the electrode portion H1104 of the first recording element substrate H1100. Furthermore, the electric wiring sheet H1300 is provided with an external signal input contact for receiving the electric signal from the main assembly apparatus, and an external signal input contact H1302 and the electrical contact H1304 are electrically connected with each other by a continuous wiring lead pattern of copper foil.

The electrical connection between the electric wiring sheet H1300 and the first recording element substrate H1100 are electrically connected by an ultrasonic heat crimping method between the bump H1105 formed at the electrode portion H1104 of the first recording element substrate H1100 and the electrical contact H1304 of the electric wiring sheet H1300 corresponding to the electrode portion H1104 of the first recording element substrate H1100.

On a flat surface around the first recording element substrate H1100 fixed at the ink retention member H1500 (that is, the surface faces to the recording material when the recording head H1000 is mounted on the carriage 102), a back side of a part of an electric wiring tape H1300 is fixed by adhesive material. An unbonded portion of the electric wiring tape H1300 is bent and is fixed by an adhesive material on a side surface substantially perpendicular to the bonding surface of the ink retention member H1500 for the first recording element substrate H1100.

(2) Second Recording Head H1001

Figure 9:
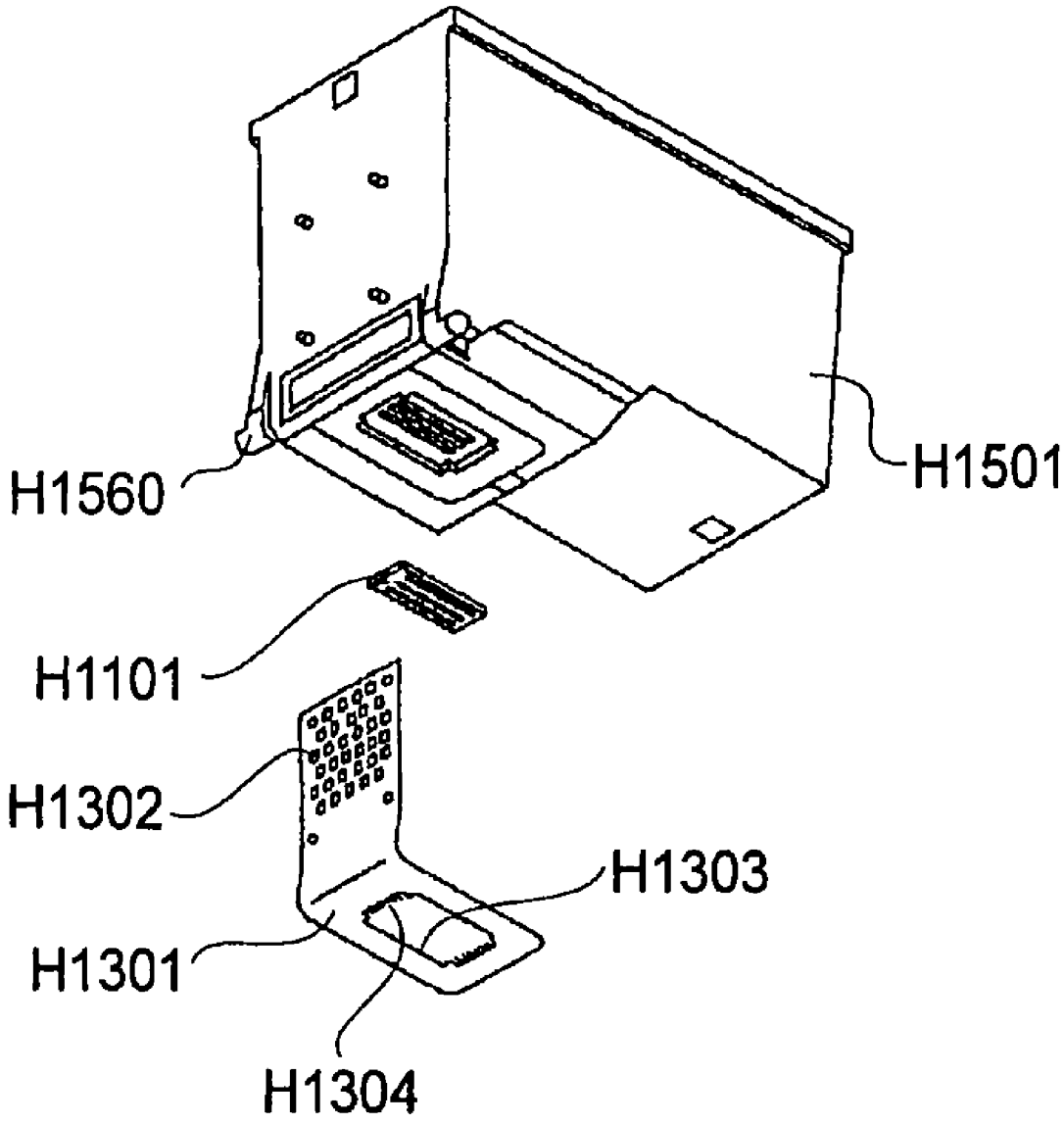
FIG. 9 is an exploded perspective view of an ink jet recording head shown in FIG. 8.

The second recording head H1001 functions to eject three color inks, namely, the cyan ink, the magenta ink and the yellow ink. As shown in FIG. 9 which is an exploded perspective view, the second recording head H1001 comprises a second recording element substrate H1101, an electric wiring sheet H1301 (electric wiring member), and an ink retention member H1501. The structures of the second recording head H1001 are similar to the first recording head H1000 described in the foregoing.

Figure 10:
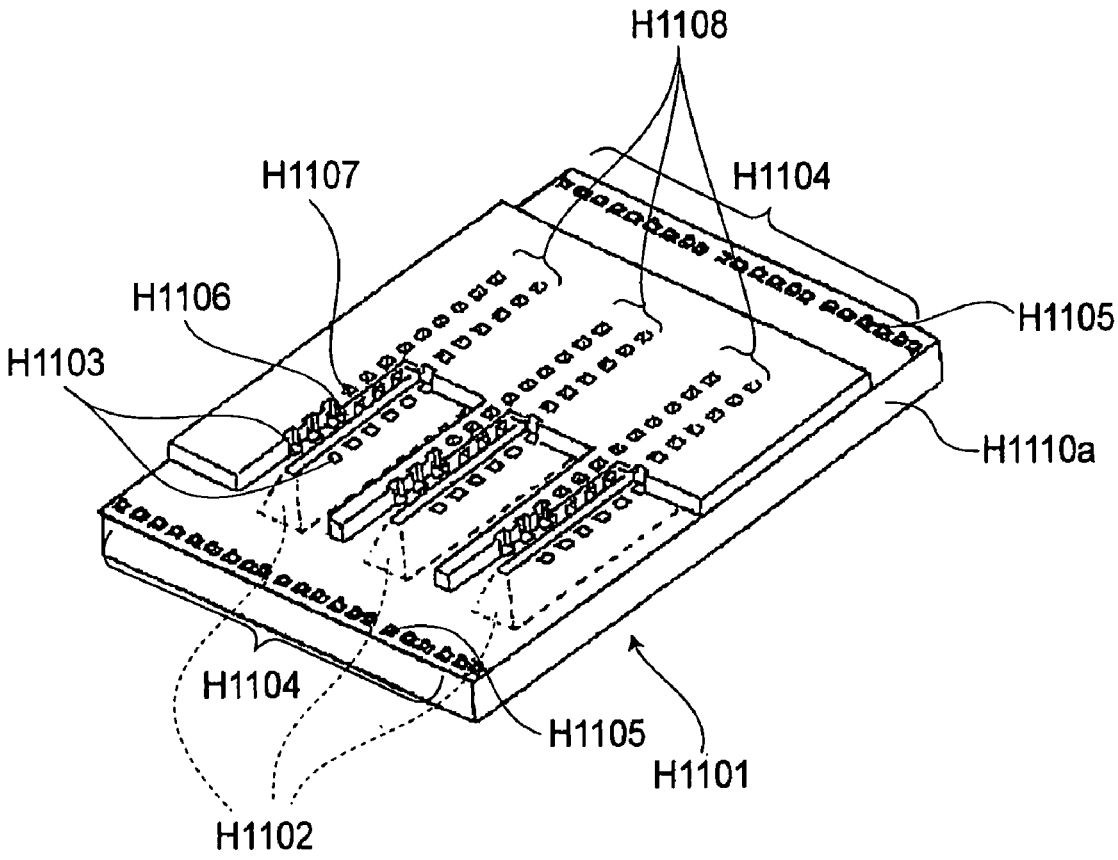
FIG. 10 is a partly broken perspective view of a second recording element substrate constituting the ink jet recording head shown in FIG. 8.

FIG. 10 is a partly broken perspective view to illustrate the structure of the second recording element substrate H1101. In the second recording element substrate H1101, three ink supply ports H1102 for the cyan ink, the magenta ink and the yellow ink are formed and are extended in parallel with each other, as is different from the first recording element substrate H1100. At respective lateral sides of each of the ink supply port H1102, electrothermal transducer elements H1103 and ejection outlets H1107 are arranged staggered, generally along a line. On the Si substrate H1110*a*, similarly to the Si substrate H1110 of the first recording element substrate H1100, electric wiring, fuses or resistances and electrode portions are formed. On the Si substrate H1110*a*, ink flow passage walls H1106 and ejection outlets H1107 are formation of resin material through a photolithography. At the electrode portion H1104 for supplying the electric power to the electric wiring, bumps H1105 of Au or the like are formed.

(Ink Jet Recording Apparatus)

Figure 12:
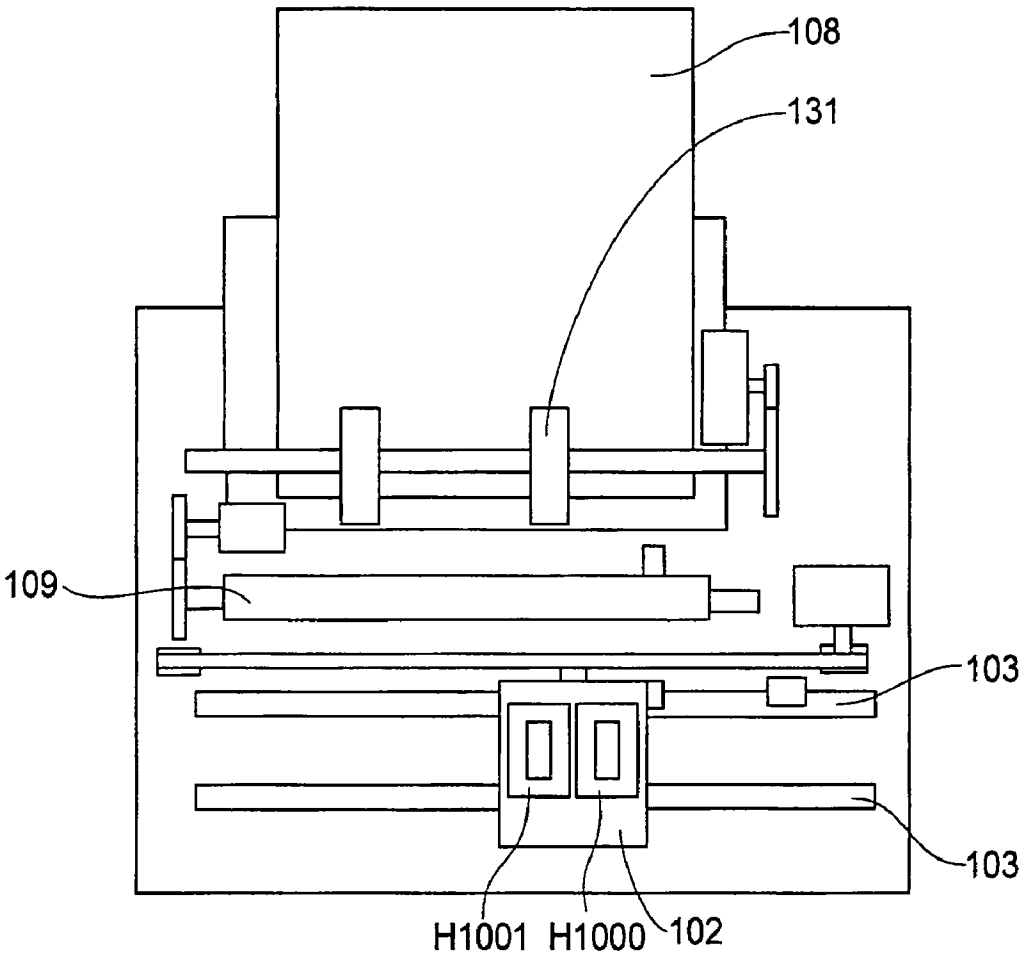
FIG. 12 is a schematic top plan view of an inside of an example of a recording device usable with the ink jet recording head according to the present invention.

The description will be made as to a recording device on which the above-described recording head is mountable. FIG. 12 is a schematic top plan view of an inside of an example of a recording device usable with the ink jet recording head of the present invention.

As will be understood from FIG. 12, the recording device comprises a carriage 102 on which the recording head H1000 shown in FIG. 5 and the recording head H1001 shown in FIG. 8 are removably mountable at a correct position. The carriage 102 is provided with an electrical connecting portion for transmitting driving signals or the like to the respective ejection portions through the external signal input contact provided on the recording heads H1000 and H1001.

As shown in FIGS. 5 and 8, the first recording head H1000 and the second recording head H1001 are guided to a predetermined position in the carriage 102 by a mounting guide H1560 for guiding the recording head to the head mounting position in the carriage 102 and by an engaging portion H1930 for fixed in g the ink jet recording head H1000 relative to the ink jet recording apparatus, and then is fixed at the position. The ink jet recording head H1000 is provided with an abutting portion H1570 for positioning itself to the predetermined mounting position in the carriage 102 in a X direction (carriage scanning direction), an abutting portion H1580 for a Y direction (a recording media feeding direction), and an abutting portion H1590 for the Z direction (ink ejecting direction). By these abutting portions, the recording head H1000 is correctly positioned relative to the carriage 102, so that proper electrical contact is established between the external signal input contacts H1302 provided on the electric wiring sheets H1300 and H1301 and the contact pins of the electrical connecting portion provided in the carriage 102.

The carriage 102 is support for reciprocal motion along the guiding shaft 103 provided in the main assembly of the apparatus and extended in the main scan direction. The recording heads H1000 and H1001*a* carried on the carriage 102 such that direction in which the ejection outlets of each of the ejection portions are arranged crosses with the scanning direction of the carriage 102. The liquid is ejected from the ejection outlet arrays onto the recording material 108 fed to the position facing the ejection outlets by a pick-up roller 131 and a feeding roller 109.

By replacing the recording head H1000 with recording heads each having the same structures as the recording head H1001 but containing light magenta ink, light cyan ink and black ink, respectively, the printer can be operated as a photographic high image quality printer.

(Results of ESD (Electrostatic Discharge) Experiments)

ESD experiments have been carried out with the second recording element substrate H1101 having the circuit shown in FIG. 11. The results are shown in Table 1.

Figure 13:
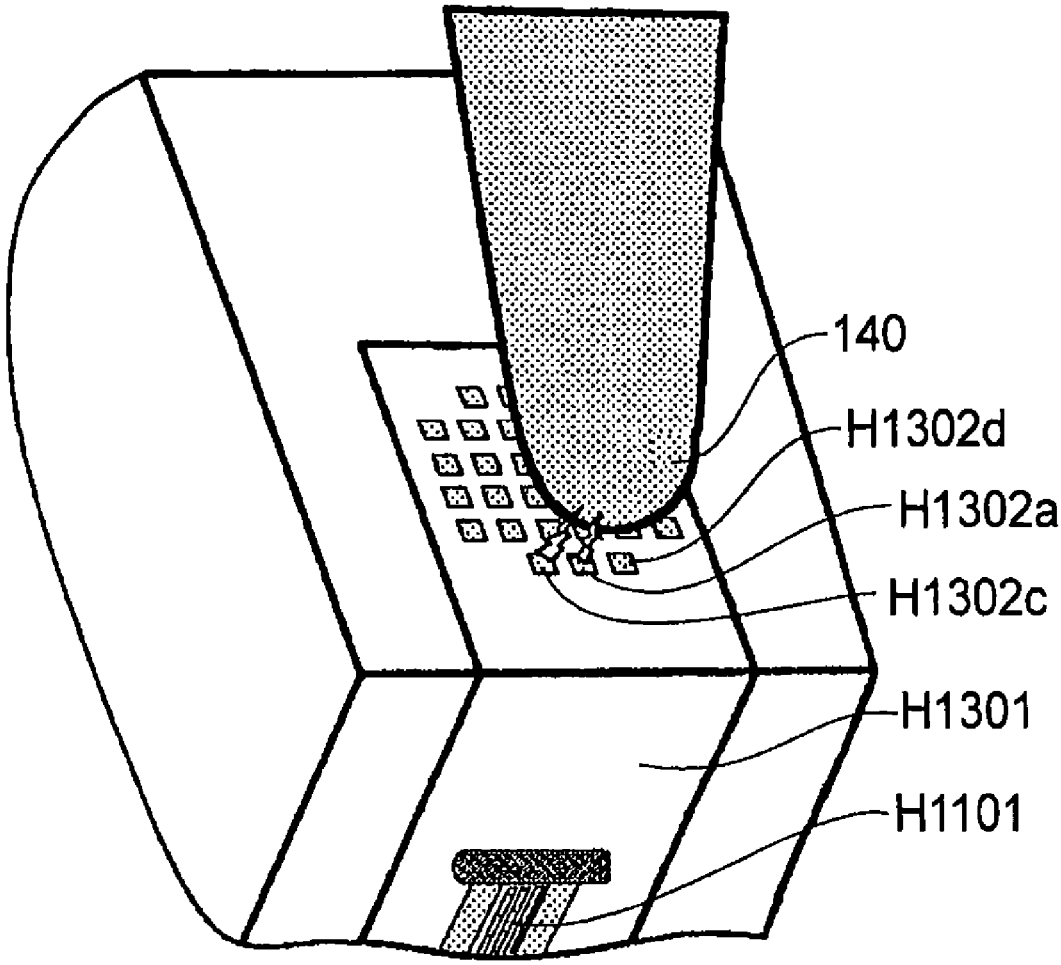
FIG. 13 is a schematic view illustrating an ESD experiment.

The electric wiring sheet H1301 under the experiments has the ID contact pad H1302*a*, the VH contact pad H1302*c*, the GNDH contact pad H1302*d* at the positions shown in FIG. 13. More particularly, the VH contact pad H1302*c* are disposed at one side of the ID contact pad H1302*a*, and the GNDH contact pad H1302*d* are disposed at the other side. The opening dimensions of each of the contact pad are 1.3 mm×1.3 mm and are arranged at the interval of 2.0 mm. The base material of the electric wiring sheet H1301 is polyimide, and a plurality of wiring lines of copper foil are electrically connected to the ID pads H1104*a*, the VH pads H1104*c* and the GNDH contact pads H1104*d*, respectively.

In FIG. 13, a semispherical test contact 140 is caused to approach to the ID contact pad H1302*a* at the position right above the ID contact pad H1302*a* and is supplied with the voltage of +20 kV, and the electric discharging to the respective contact pads are observed. The experiments are carried out with four samples, and the results are as follows.

TABLE 1

(Occurrences of electric discharge)

| | Locations | | |
|---|---|---|---|
| | ID pad | VH pad | GNDH pad |
| Sample 1 | Yes | Yes | No |
| Sample 2 | No | No | Yes |
| Sample 3 | No | Yes | No |
| Sample 4 | No | Yes | Yes |
| Frequencies of occurrences | 1/4 | 3/4 | 2/4 |

The results of experiments show that although the discharge is tried aiming at the ID contact pad H1302*a*, the discharge occurred to the ID contact pad H1302*a* only in one of the four samples. Therefore, it is understood that discharge to the ID contact pad can be effectively impeded by the existence of the VH contact pad and/or the GNDH contact pad adjacent the ID contact pad. In the case of sample 1 with which the discharge occurred to the ID contact pad, the discharge to the VH contact pad also occurred simultaneously. From this result, it is understood that discharge to the ID contact pad is diffused by the existence of the adjacent VH contact pad and/or GNDH contact pad.

In the foregoing description, the storing element is provided in the recording element substrate. But, similar effects are provided when a similar storing element is provided in another substrate.

As described in the foregoing, in the recording head of this embodiment, one or both of the VH contact pad and the GNDH contact pad are disposed at both of the sides of the ID contact pad adjacent thereto, so that discharge to the ID contact pad is effectively impeded. By doing so, the adverse influence, to the storing element, of the static electricity attack upon contact of the user's hand or finger to the head when the head is mounted to the carriage or to the main assembly of the apparatus, is prevented. Recently, the circuit on the substrate for the ink jet recording is improved, it is quite durable against the static electricity, and therefore, the countermeasurement against the static electricity would be sufficient if the disposition of the contact pad of these embodiments of the present invention are employed.

The description will be made as to the positional relation among the ID contact pad, the VH contact pad and the GNDH contact pad with more specific examples.

Embodiment 1

Figure 1:
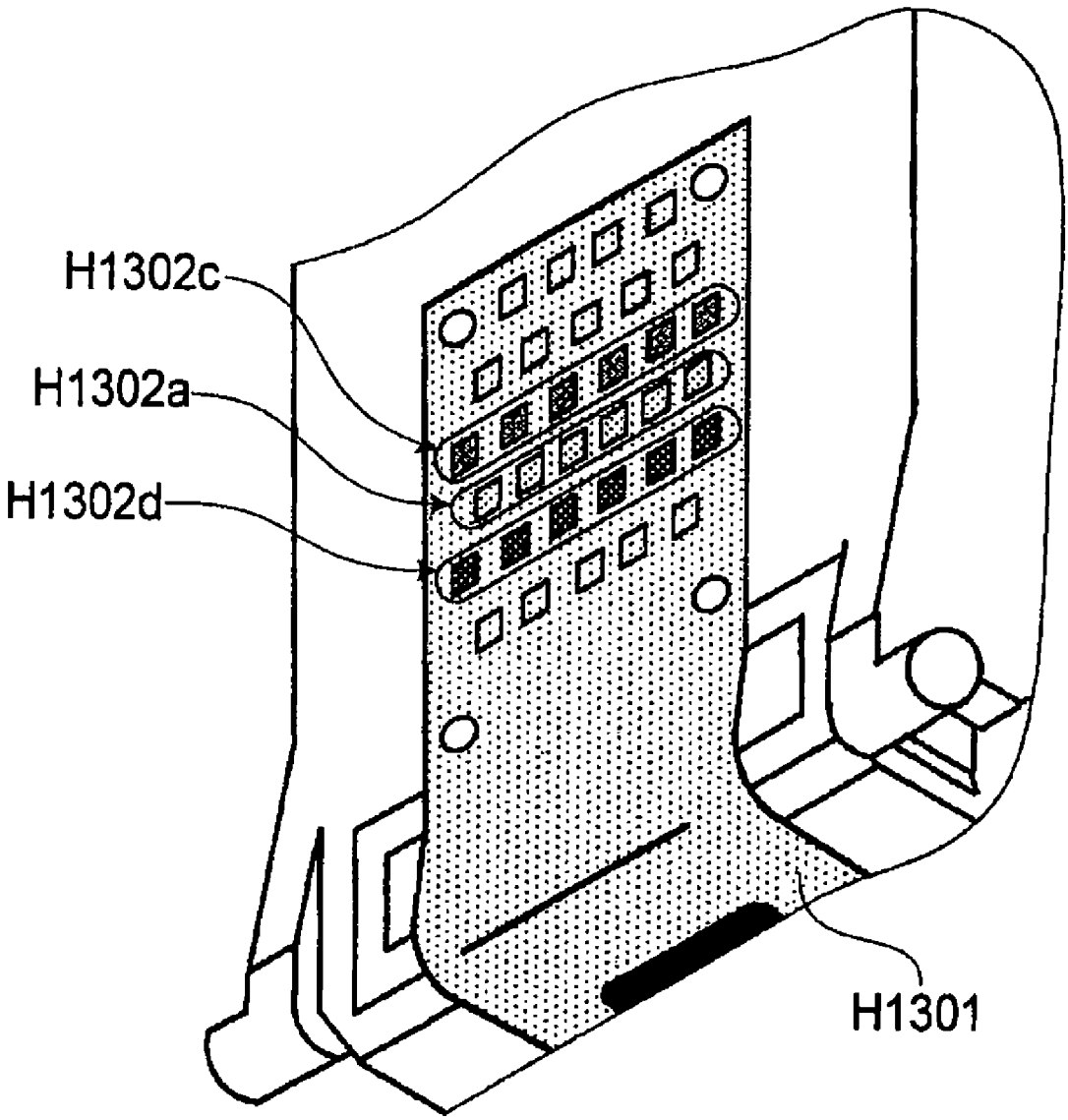
FIG. 1 is a schematic view of a wiring substrate of an ink jet recording head according to a first embodiment of the present invention.

Referring to FIG. 1, the description will be made as to an ink jet recording head according to the first embodiment of the present invention.

FIG. 1 is an enlarged view of the external signal input contact portion of the electric wiring sheet of the second recording head used with the ink jet recording head of this embodiment. Referring to FIG. 1, the electric wiring sheet H1301 is provided with 32 external signal input contacts H1302. Of these external signal input contacts H1302, six pads are ID contact pads H1302*a* which are disposed substantially at the central portion of the portion where the external signal input contacts H1302 are disposed. The ID contact pads H1302*a* are respectively connected to the ID pads connected with the fuse H1117 (a simple connecting line or the resistance element (FIG. 11)) provided at the opposite ends of each of the three ink supply ports H1102 of the second recording element substrate H1101 shown in FIG. 10.

Six VH contact pads H1302*c* are disposed along one side of the array of the ID contact pads H1302*a* (the side above the array of the ID contact pads H1302*a* in FIG. 1) adjacent the ID contact pad H1302*a* array. More particularly, in this embodiment, the VH contact pads H1302*c* are immediately adjacent to the ID contact pad H1302*a* array (namely, with no ID contact pad H1302*a* therebetween). These VH contact pads H1302*c* are electrically connected to the VH pads H1104*c* (FIG. 11) provided in the electrode portion H1104 (FIG. 10) at the opposite ends of the second recording element substrate H1101.

Six GNDH contact pads H1302*d* are arranged along the array of the ID contact pads H1302*a* on the other side, that is, the side below the array of the ID contact pads H1302*a* in FIG. 1. More particularly, in this embodiment, the GNDH contact pads H1302*d* are immediately adjacent to the ID contact pad H1302*a* array (namely, with no ID contact pad H1302*a* therebetween). These VH contact pads H1302 *d* are electrically connected to the GNDH pads H1104 (FIG. 11) provided in the electrode portion H1104 (FIG. 10) at the opposite ends of the second recording element substrate H1101.

The other external signal input contacts H1302 other than the ID contact pads H1302*a*, the VH contact pads H1302*c* and the GNDH contact pad H1302*d*, are used for electric power supply to the transistors, sending and receiving signals such as control signals or the like.

In the case of the ink jet recording head of the present invention, the ID contact pads H1302*a* which are relative weak against the attach of static electricity are positioned substantially at the central portion of the external signal input contact portion H1302. This position is hard to be touched by the user, when the user manipulates the second recording head by hand. Usually, the user is more or less conscious so as not to touch the external signal input contact H1302, and therefore, the pads disposed at the center portion is not easily touched.

In addition, the ID contact pads H1302*a* are adjacent to and interposed between the VH contact pad H1302*c* and the GNDH contact pad H1302*d*, and therefore, if an electrically charged finger of the user is brought so close to the ID contact pad H1302*a* that electrical discharge occurs, the discharge tends to be toward the VH contact pad H1302*c* and/or to the GNDH contact pad H1302*d* rather than toward the ID contact pad H1302*a*. Thus, the structure of the present invention is such that peculiar information in the head is not broken, overwritten or rewritten.

Embodiment 2

Figure 2:
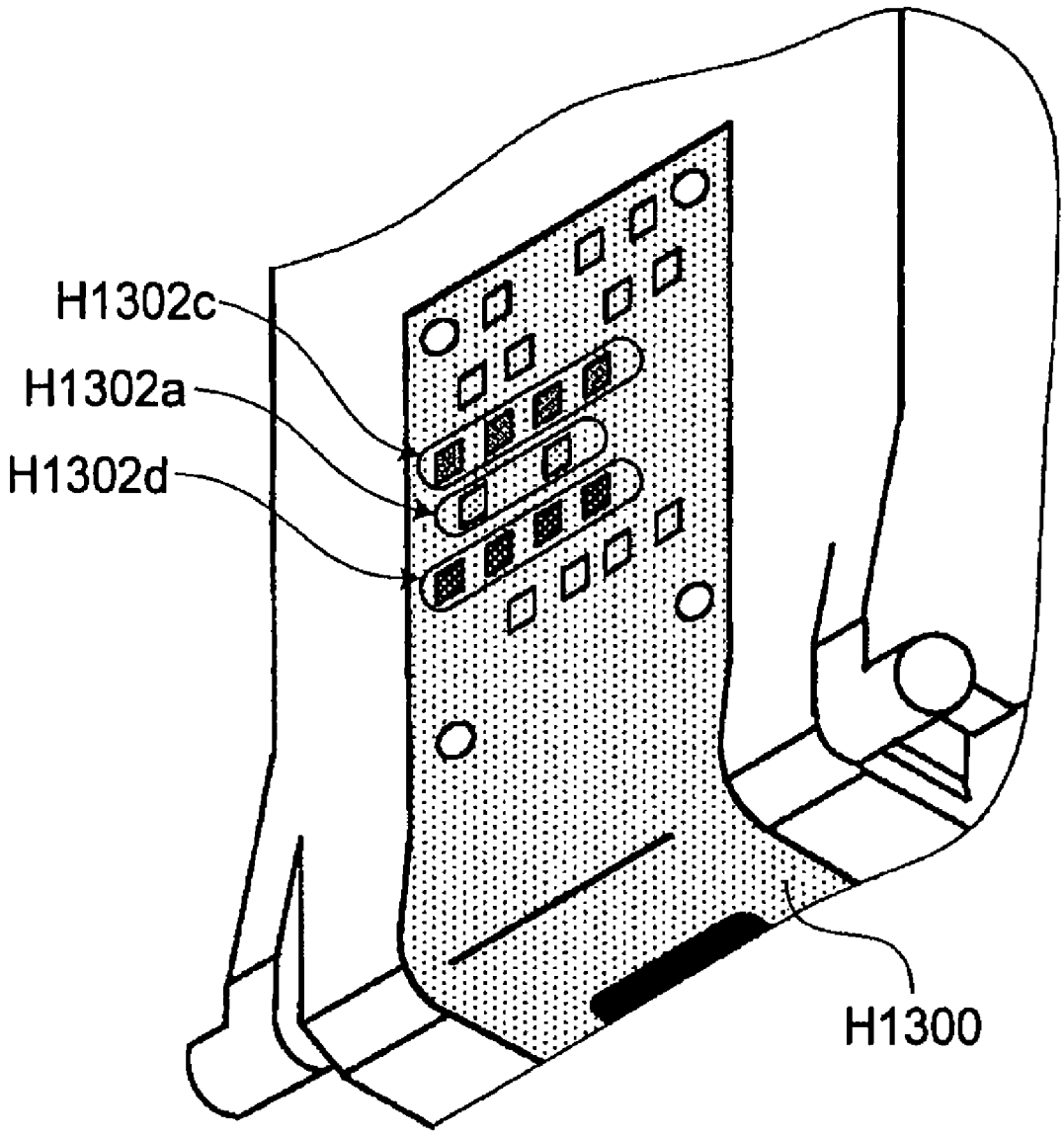
FIG. 2 is a schematic view of a wiring substrate of an ink jet recording head according to a second embodiment of the present invention.

Referring to FIG. 2, the description will be made as to an ink jet recording head according to a second embodiment of the present invention.

FIG. 2 is an enlarged view of an external signal input contact portion of electric wiring of a first recording head usable with an ink jet recording head according to this embodiment. Referring to FIG. 2, the electric wiring sheet H1300 is provided with 21 external signal input contacts H1302. The first recording head is for the black ink, and therefore, the numbers of the electric power supply contacts, the control signal contacts are smaller than the second recording head for the cyan, magenta and yellow inks, as described in the first embodiment.

However, the carriage 102 of the main assembly of the ink jet recording apparatus is capable of accepting the third recording head which is for the photographic printing and which has the same structure as the second recording head, at the position where the first recording head is removed. Therefore, the positions of the 21 external signal input contacts H1302 correspond to the positions of the external signal input contacts H1302 of the second recording head when the head is mounted to the carriage 102.

The number of the ID contact pads H1302*a* of the external signal input contacts H1302 on the electric wiring sheet H1300, six, and the positions thereof are substantially at the center of the portion where the external signal input contacts H1302 are provided. The ID contact pads H1302*a* are connected to the ID pads which in turn is connected to a fuse H1117, a simple wiring line or a resistance element, FIG. 11) disposed at each of the opposite ends of the ink supply port H1102 of the first recording element substrate H1100.

Four VH contact pads H1302*c* are arranged along and adjacent to the array of the ID contact pad H1302*a* at one lateral side (above the array of the ID contact pads H1302*a* in FIG. 2. More particularly, in this embodiment, the VH contact pads H1302*c* are immediately adjacent to the ID contact pad H1302*a* array (namely, with no ID contact pad H1302*a* therebetween). The VH contact pads H1302*c* are connected to the VH pads H1104*c* (FIG. 11) provided in the electrode portion H1104 (FIG. 7) disposed at the opposite ends of the first recording element substrate.

Four GNDH contact pads H1302*d* are arranged along and adjacent to the array of the ID contact pad H1302*a* at one lateral side (below the array of the ID contact pads H1302*a* in FIG. 2. More particularly, in this embodiment, the GNDH contact pads H1302 *d* are immediately adjacent to the ID contact pad H1302*a* array (namely, with no ID contact pad H1302*a* therebetween). The GNDH contact pads H1302*d* are connected to the GNDH pads H1104 (FIG. 11) provided in the electrode portion H1104 (FIG. 7) at the opposite ends of the recording element substrate H1100.

The other external signal input contacts H1302 other than the ID contact pads H1302*a*, the VH contact pads H1302*c* and the GNDH contact pad H1302*d*, are used for electric power supply to the transistors, sending and receiving signals such as control signals or the like.

According to the ink jet recording head of this embodiment, similarly to the first embodiment, the ID contact pads H1302*a* which are relative weak against the attach of static electricity are positioned substantially at the central portion of the external signal input contact portion H1302, and therefore, the user does not easily touch the ID contact pad H1302*a*.

In addition, the ID contact pads H1302*a* are adjacent to and interposed between the VH contact pads H1302*c* and the GNDH contact pads H1302*d*, and therefore, even when if an electrically charged finger of the user is brought so close to the ID contact pad H1302*a* that electrical discharge occurs, the discharge tends to be toward the VH contact pad H1302*c* and/or to the GNDH contact pad H1302*d* rather than toward the ID contact pad H1302*a*, and therefore, the peculiar information in the head is not easily broken, overwritten or rewritten.

Embodiment 3

Figure 3:
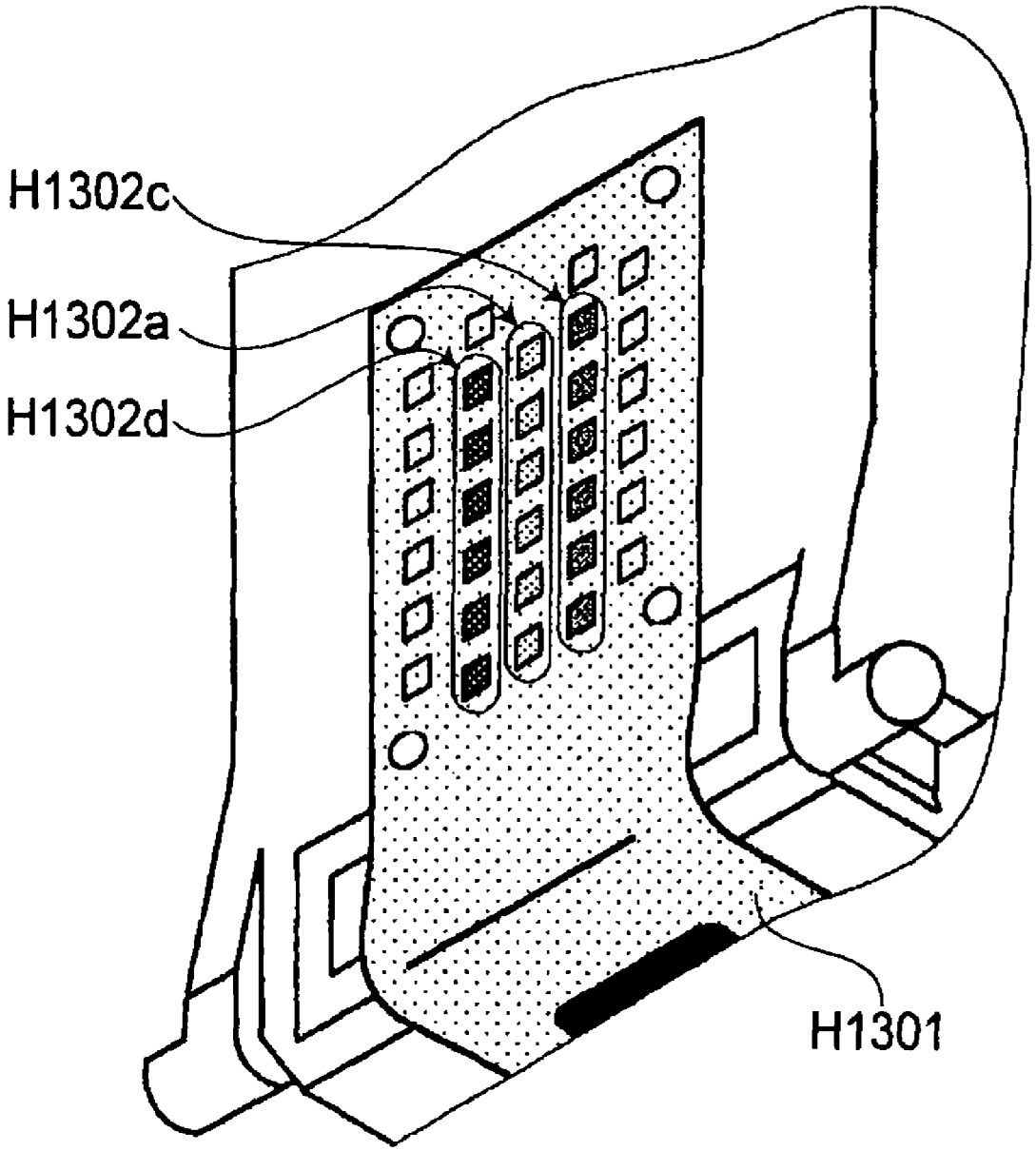
FIG. 3 is a schematic view of a wiring substrate of an ink jet recording head according to a third embodiment of the present invention.

Referring to FIG. 3, the third embodiment will be described.

FIG. 3 is an enlarged view of the external signal input contact portion of the electric wiring sheet of the second recording head used with the ink jet recording head of this embodiment. A second type recording head of this embodiment uses the second recording element substrate H1101 which is the same as the first embodiment, and the difference from the first embodiment is only in the disposition of the external input contacts H1302 on the external electric wiring.

Six pads of 32 external signal input contacts H1302 provided on the electric wiring sheet H1301 are ID contact pads H1302*a*. The ID contact pads H1302*a* are arranged in a longitudinal direction (in the direction of the length of the electric wiring sheet H1301) at the center of the portion where the external signal input contacts H1302 are provided.

Along the array of the ID contact pads H1302*a*, six VH contact pads H1302*c* are arranged adjacent thereto at one lateral side thereof, and six GNDH contact pads H1302*d* are arranged adjacent thereto at the other lateral side thereof. More particularly, in this embodiment, the VH contact pads H1302*c* are immediately adjacent to the ID contact pad H1302*a* array (namely, with no ID contact pad H1302*a* therebetween), and the GNDH contact pads H1302 *d* are immediately adjacent to the ID contact pad H1302*a* array (namely, with no ID contact pad H1302*a* therebetween).

According to the ink jet recording head of this embodiment, similarly to the first embodiment, the ID contact pads H1302*a* which are relative weak against the attach of static electricity are positioned substantially at the central portion of the external signal input contact portion H1302, and therefore, the user does not easily touch the ID contact pad H1302*a*.

In addition, the ID contact pads H1302*a* are adjacent to and interposed between the VH contact pads H1302*c* and the GNDH contact pads H1302*d*, and therefore, even if an electrically charged finger of the user is brought so close to the ID contact pad H1302*a* that electrical discharge occurs, the discharge tends to be toward the VH contact pad H1302*c* and/or to the GNDH contact pad H1302*d* rather than toward the ID contact pad H1302*a*, and therefore, the peculiar information in the head is not easily broken, overwritten or rewritten.

Embodiment 4

Figure 4:
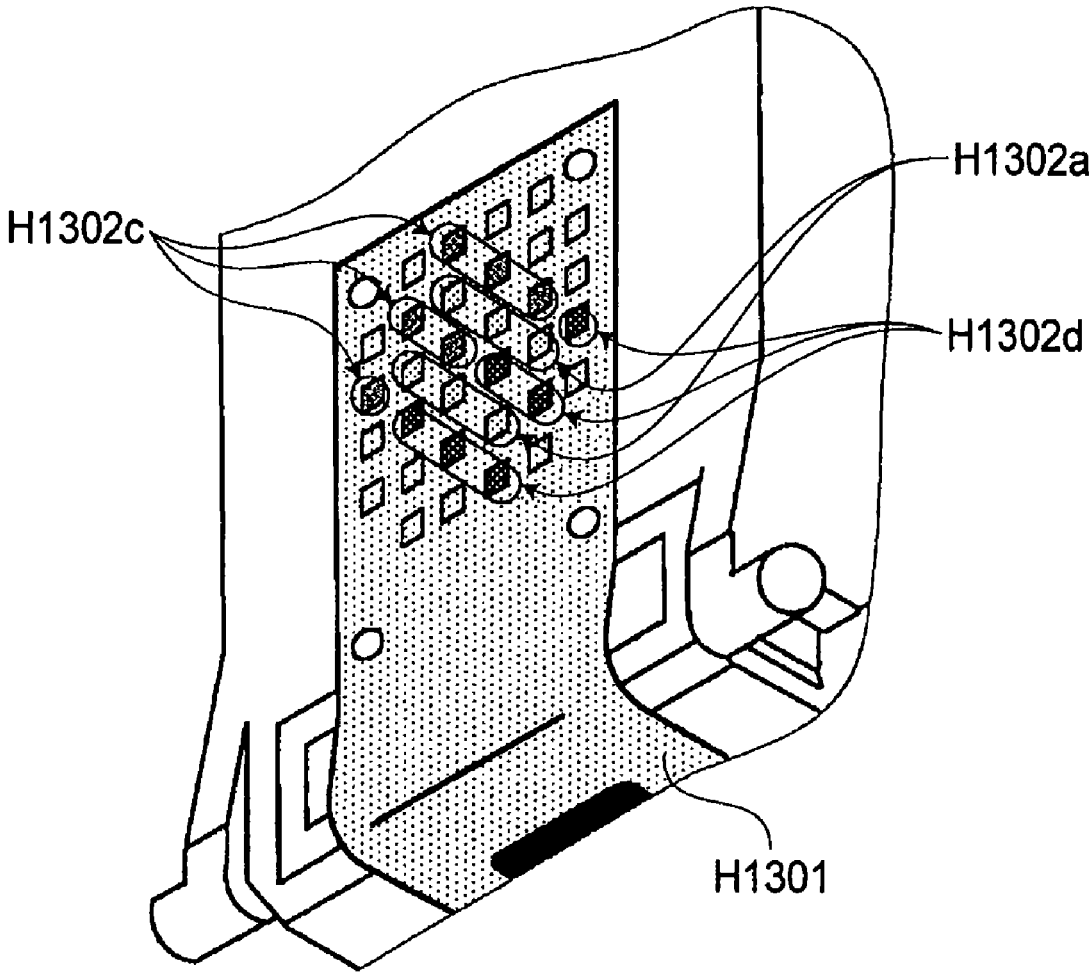
FIG. 4 is a schematic view of a wiring substrate of an ink jet recording head according to a fourth embodiment of the present invention.

Referring to FIG. 4, an ink jet recording head according to a fourth embodiment will be described.

FIG. 4 is an enlarged view of the external signal input contact portion of the electric wiring sheet of the second recording head used with the ink jet recording head of this embodiment. A second type recording head of this embodiment uses the second recording element substrate H1101 which is the same as the first embodiment, and the difference from the first embodiment is only in the disposition of the external input contacts H1302 on the external electric wiring.

Six pads of 32 external signal input contacts H1302 provided on the electric wiring sheet H1301 are ID contact pads H1302*a*. The ID contact pads H1302*a* are disposed substantially at the central portion of the portion where the external signal input contacts H1302 are provided. Around the ID contact pads H1302*a* (above, below, left side and right side of the ID contact pads H1302*a* in FIG. 4), the VH contact pads H1302*c* and/or the GNDH contact pads H1302*d* are disposed at positions adjacent thereto. Each of the ID contact pads H1302*a* is are interposed between the VH contact pads H1302*c* and the GNDH contact pads H1302*d* in the longitudinal direction and in the transverse direction. In other words, two arrays of three ID contact pads H1302*a* extend inclined at the central portion of the portion where the external signal input contacts H1302 are provided, and three arrays which comprise six VH contact pads H1302*c* and six GNDH contact pads H1302*d* extend so as to interpose the respective ones of the arrays of the ID contact pads H1302*a*.

According to the ink jet recording head of this embodiment, each of the ID contact pads H1302*a* are interposed between the VH contact pads. H1302*c* or the GNDH contact pads H1302*d* which are disposed around it, more particularly, at the top, bottom, left and right. For this reason, the peculiar information in the head of this embodiment is less easily broken, overwritten or rewritten then in the heads of the other embodiments. More particularly, in this embodiment, the VH contact pads H1302*c* are immediately adjacent to the ID contact pad H1302*a* array (namely, with no ID contact pad H1302*a* therebetween), and the GNDH contact pads H1302 *d* are immediately adjacent to the ID contact pad H1302*a* array (namely, with no ID contact pad H1302*a* therebetween).

The ink jet recording head of any of the foregoing embodiments is not limited to those of the ejecting types, but is applicable to the ink jet recording heads of various ink ejecting types.

The external signal input contacts in any of the foregoing embodiments, may be a pad connected to the similar set of pads. As to the ID contact pads, they may be usable as information writing pads when the storing element is an information writable (not only readable) element.

According to the foregoing embodiments, the problem of the overwriting or rewriting of individual information in the storing element due to the static electricity upon the head mounting, can be solved.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 164555/2004 filed Jun. 2, 2004, which is hereby incorporated by reference.

What is claimed is:

1. A liquid ejecting head mountable to a liquid ejecting apparatus, said liquid ejecting head comprising:

a recording element for generating energy for effecting recording by ejecting liquid in response to a driving voltage applied thereto;

an electric power line, connected to said recording element, for supplying the driving voltage to said recording element;

a grounding electrical line, connected to said recording element, for electrically grounding said recording element;

a storing element for storing individual information; and a plurality of head electrical contacts electrically connectable to electrical contacts provided in the apparatus when said head is mounted to the apparatus, said head electrical contacts including a plurality of first electrical contacts, each connected electrically with said storing element, and a plurality of second electrical contacts, each connected electrically with said recording element through said electric power line or said grounding electrical line, wherein adjacent to one side of each of said first electrical contacts, at least one of said second electrical contacts is disposed without any of said first electrical contacts interposed therebetween, and adjacent to the other side of each of said first electrical contacts which is opposite the one side, at least one of said second electrical contacts is disposed without any of said first electrical contacts interposed therebetween.

2. A liquid ejecting head according to claim 1, wherein said first electrical contacts form a first contact array, and said second electrical contacts form second contact arrays, with the first contact array interposed between the second contact arrays.

3. A liquid ejecting head according to claim 1, wherein said first electrical contacts form first contact arrays, and said second electrical contacts form second contact arrays, with each of the first contact arrays directly interposed between the second contact arrays.

4. A liquid ejecting head according to claim 1, wherein the information is indicated by presence or absence of an electrical interconnection in said storing element.

5. A liquid ejecting head according to claim 1, wherein said storing element comprises a fuse disconnected upon an application of an external electrical signal.

6. A liquid ejecting head according to claim 1, wherein said storing element comprises a resistance element.

7. A liquid ejecting head according to claim 1, further comprising a liquid container for storing liquid.

8. A liquid ejecting apparatus usable with a liquid ejecting head for ejecting liquid, said apparatus comprising:

a liquid ejecting head according to claim 1; and a carriage reciprocable in a predetermined direction while carrying said liquid ejecting head.

9. A liquid ejecting head according to claim 2, wherein said first electrical contacts are directly interposed between said second electric contacts in a direction of the first contact array and in a direction of the second contact array which crosses with the direction of the first contact array.

10. A liquid ejecting head according to claim 2, wherein the first contact array does not comprise any of said second electrical contacts.

11. A liquid ejecting head according to claim 2, wherein the second contact arrays do not comprise any of said first electrical contacts.

* * * * *